United States Patent [19]

Kumar et al.

[11] Patent Number: 5,007,972

[45] Date of Patent: Apr. 16, 1991

[54] SAMARIUM-TRANSITION METAL MAGNET FORMATION

[75] Inventors: Kaplesh Kumar, Wellesley; Herbert A. Newborn, Marblehead, both of Mass.

[73] Assignee: The Charles Stark Draper Laboratory, Inc., Cambridge, Mass.

[21] Appl. No.: 204,633

[22] Filed: Jun. 9, 1988

[51] Int. Cl.[5] ..... H01F 1/08

[52] U.S. Cl. ..... 148/102; 148/103; 148/105

[58] Field of Search ..... 148/102, 103, 104, 105, 148/301, 303

[56] References Cited

U.S. PATENT DOCUMENTS

| | | | |
|---|---|---|---|
| 4,322,257 | 3/1982 | Menth et al. | 148/301 |
| 4,484,957 | 11/1985 | Hiouchi et al. | 148/303 |
| 4,664,723 | 5/1987 | Ishii et al. | 148/301 |

FOREIGN PATENT DOCUMENTS

| | | | |
|---|---|---|---|
| 117340 | 9/1984 | European Pat. Off. | 148/303 |
| 60-502 | 5/1985 | Japan | 148/301 |
| 17125 | 5/1986 | Japan | 148/301 |
| 2089371 | 6/1982 | United Kingdom | 148/303 |

*Primary Examiner*—Theodore Morris
*Assistant Examiner*—George Wyszomierski
*Attorney, Agent, or Firm*—Weingarten, Schurgin, Gagnebin & Hayes

[57] ABSTRACT

A process for fabricating high strength $Sm_2TM_{17}$ (TM = transition metal) magnets is disclosed. An alloy is crushed and pulverized to a very fine powder. The powder is aligned in a magnetic field, cold pressed to substantially immobilize the powder particles and then compacted by hot isostatic pressing. The material is either homogenized at this time or prior to crushing. Thereafter, the powder is optimized by an aging heat treatment which includes isothermal exposure followed by controlled cooling. When aging is complete, the compact is magnetized.

10 Claims, 3 Drawing Sheets

SAMARIUM-TRANSITION METAL MAGNET FORMATION

FIELD OF THE INVENTION

The invention relates to magnet fabricating processes and in particular, to a series of staged treatment steps for fabricating high strength magnets.

BACKGROUND OF THE INVENTION

Conventional processes for fabricating high strength magnets entail sintering selected aligned powder compositions at high temperatures. A high temperature solutionizing treatment is then performed, followed by rapid cooling to room temperature. The solutionized composition is then aged at an elevated temperature, which is lower than the solutionizing temperature, prior to slow cooling to an intermediate temperature and then further cooled to room temperature and magnetized. Using the conventional process, a 33-MGOe maximum energy product magnet has been produced from Sm (Cu, Fe, Zr, Co)$_z$ (z=6.8 to 7.7) type compositions. However, there are disadvantages associated with the conventional fabricating process. To reduce oxygen contamination, sintering is preferably performed in an atmosphere of argon. During the sintering process, large grain growth occurs and argon is trapped within pores in the magnet. This is expected to negatively impact the mechanical strength of the magnet. In addition, the production of radial ring rare earth transition metal magnets has not been successful when fabricating processes which include a sintering procedure are utilized. Full circle radial ring magnets, however, are extremely useful in a variety of applications.

SUMMARY OF THE INVENTION

The novel fabricating process of the present invention relates to a process for producing high strength permanent magnets, including full circle radial ring magnets. The process includes homogenizing a composition, typically a rare earth transition metal alloy in ingot form, by heat treatment and then pulverizing and milling or otherwise reducing the alloy to a powder having grains of a size of several microns. The grains are aligned by exposure to a magnetic field and then substantially immobilized by cold pressing. Thereafter, the powder compact is hot isostatically pressed and optimized by aging heat treatment. Finally, the densified compact is magnetized. Alternatively, homogenization of the densified compact may occur directly after hot isostatic pressing.

The sequence of steps including heat treatment and compacting achieves grain size control which increases mechanical and magnetic strength of the magnet.

DESCRIPTION OF THE INVENTION

A more complete understanding of the invention and its various features, objects and advantages may be obtained from the following detailed description when taken in conjunction with the attached drawings in which:

FIGS. 1A and B are a flow chart of the process of the present invention.

DETAILED DESCRIPTION

Figure 1A:
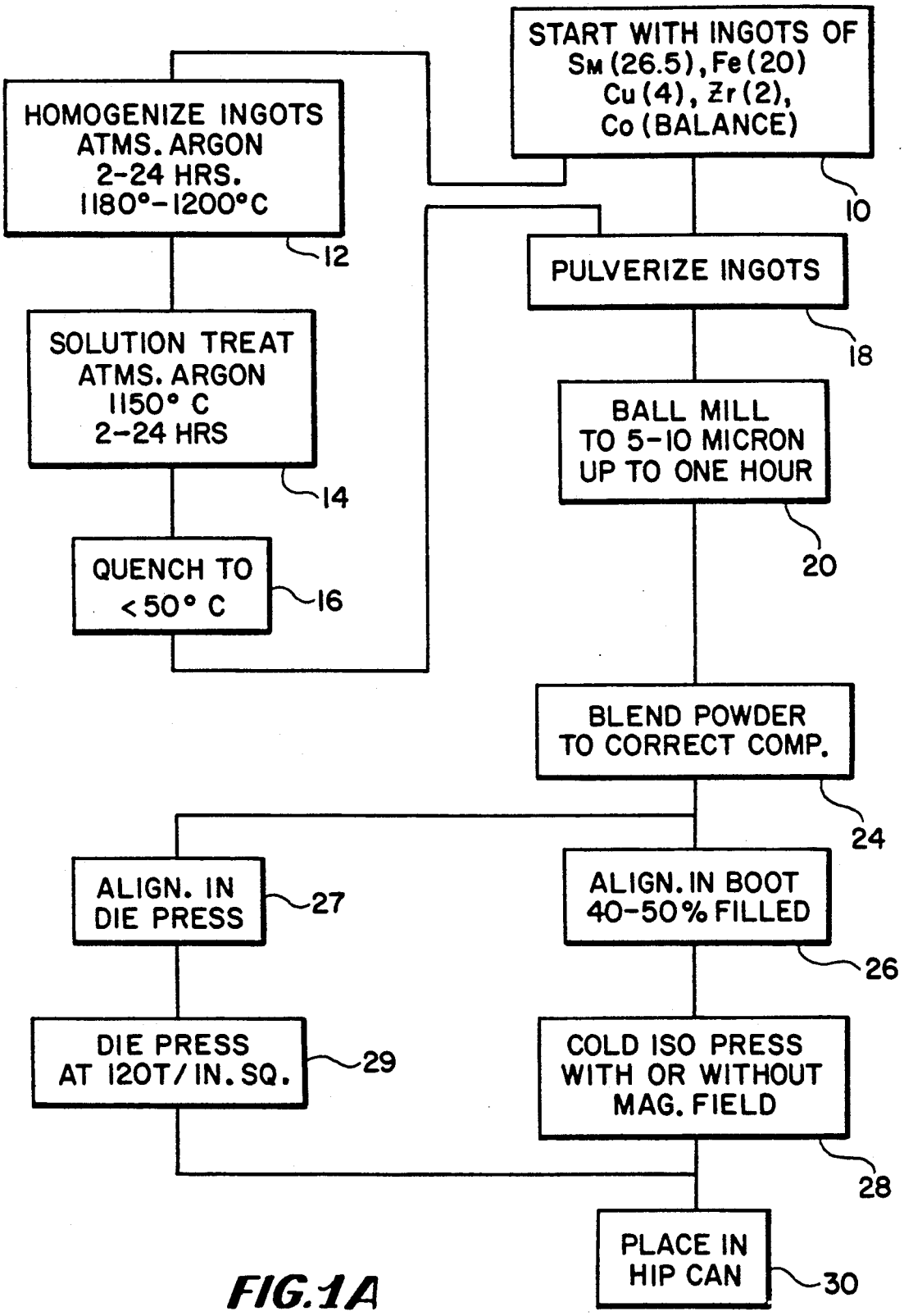
Figure 1B:
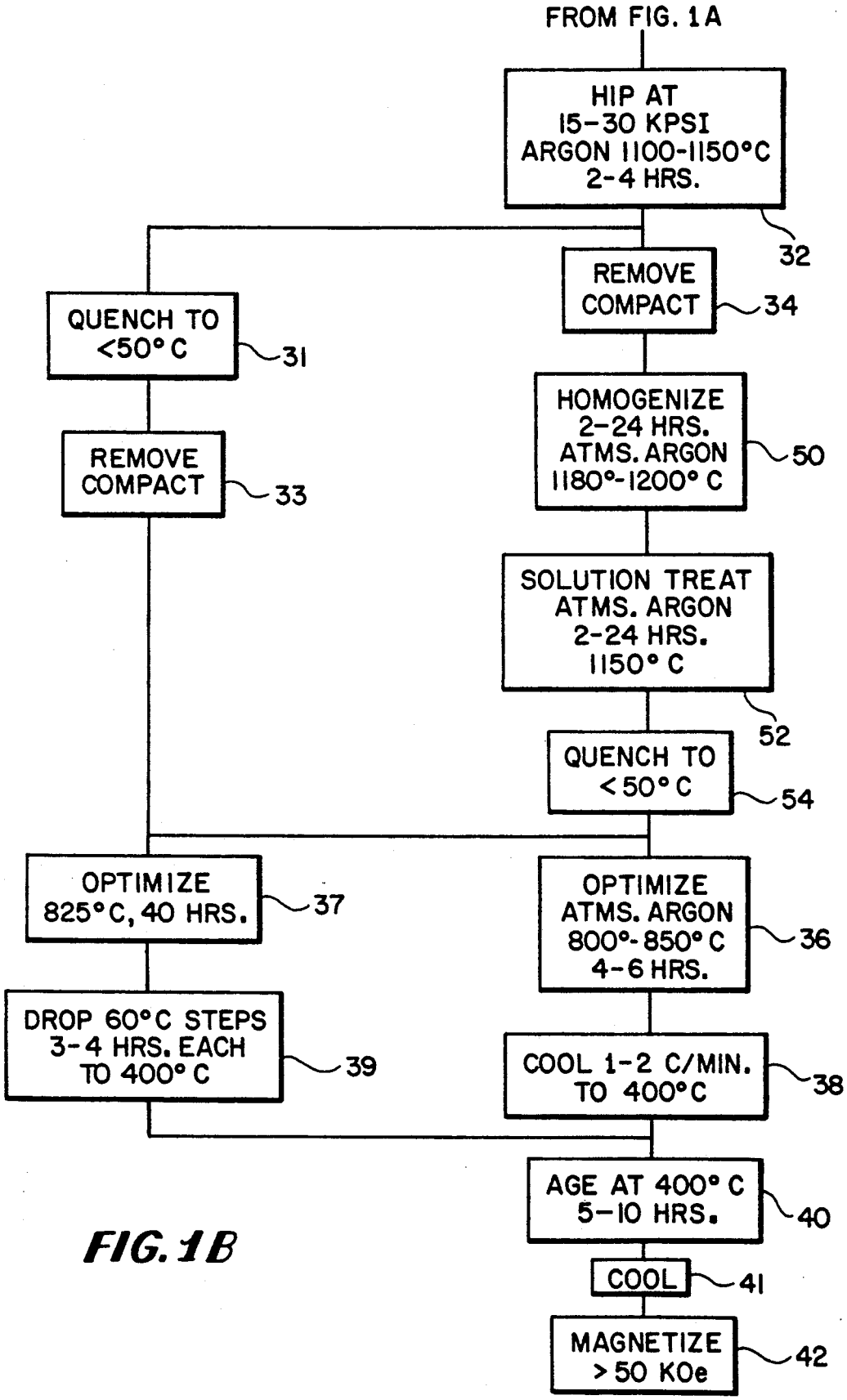

Referring initially to FIGS. 1A and 1B, a flow chart of processing according to the present invention is illustrated. In step 10, ingots of the required composition are selected. Ingots of the alloy Sm (26.5) Fe (20) Cu (4) Zr (2) Co (balance) weight percentages have been found to produce the high strength magnets when processed using the present invention and are preferred.

In step 12, according to a first alternative, the alloy ingots are placed in an argon atmosphere within a furnace (described below with respect to FIG. 4) at atmospheric pressure for 2–24 hours and maintained at a temperature of about 1180°–1200° C. for homogenization of the alloy components. In step 14, the ingots are placed in the argon furnace at atmospherical pressure for a further 2–24 hours for solution treatment at approximately 1150° C. In step 16, the solution treated alloy ingots are quenched from the solution treatment temperature by putting them into a less than 50° C. section of the furnace. After quenching, the ingots are pulverized, in step 18, and then ball-milled, preferrably not in a toluene medium, and reduced to a powder having powder particles of 5–10 micron size in step 20. Alternatively, pulverizing step 18 may proceed directly without homogenizing steps 12, 14 and 16 at this time. Ball-milling, such as in a laboratory attritor, for up to one hour has been found sufficient to reduce the pulverized ingots to the desired powder size with high size consistency. In step 24, further powders may be blended with the previously powdered material to obtain the desired powder composition. Alternatively, supplemental material can be added during step 20 to obtain the desired composition in which case the supplemental material is ball-milled with the pulverized ingots. For example, a SmCo powder of 5–10 micron powder size can be added to achieve the correct weight percentages. When the desired powder composition is obtained, the powder is magnetically aligned by exposure to a magnetic field in a step 26.

Figure 2:
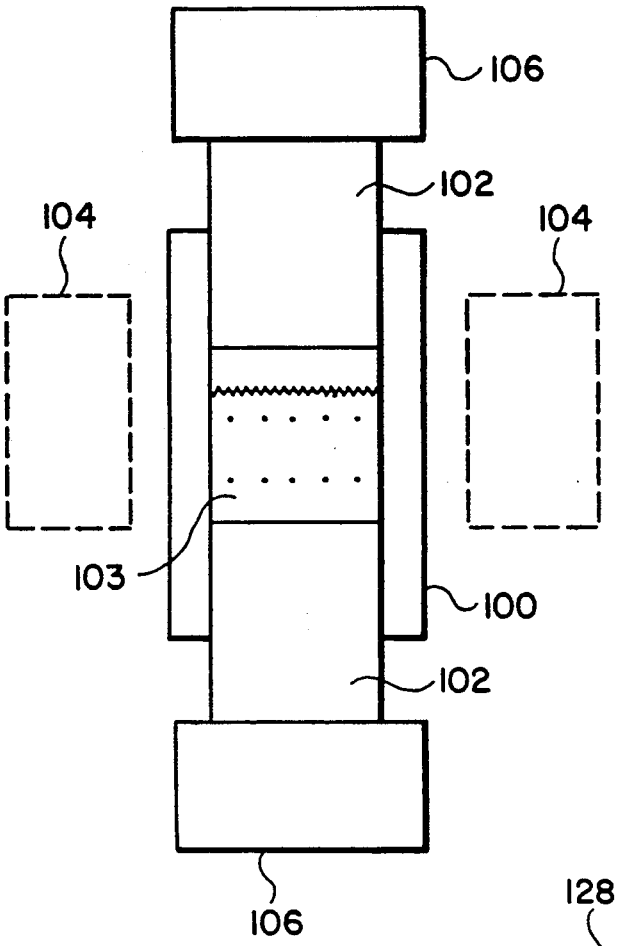
FIG. 2 illustrates a cold isostatic press used in the invention.

Referring now also to FIG. 2, step 26 is effected by 40–50% filling a boot 100, in this case a rubber boot, with the powder 103. The rubber boot 100 has dimensions appropriate to the pressure to be applied. The rubber boot 100 is sealed by plugs 102 at each end. Magnet poles 106 create a uniform magnetic field in excess of 10KOe which is maintained axially through rubber boot 100. Alternatively, magnet poles 104 can be placed orthogonal to the axis of rubber boot 100 to align the powder 103 orthogonally to the axis of rubber boot 100.

Filling rubber tube 100 to only 40–50% permits the powder 103 to shift during magnetic alignment according to the respective direction of the magnetic field. Lightly tapping rubber boot 100 stimulates alignment of the powder 103. After alignment of the powder 103, rubber boot 100 is physically placed in a cold isostatic press in a fluid environment to compact the powder 103 and produce an immobilized compact in step 28. In the cold isostatic press, the powder 103 is subjected to pressures of 50–60 KPSI. The compacting step 26 may be practised either with or without the magnetic field applied.

Figure 3:
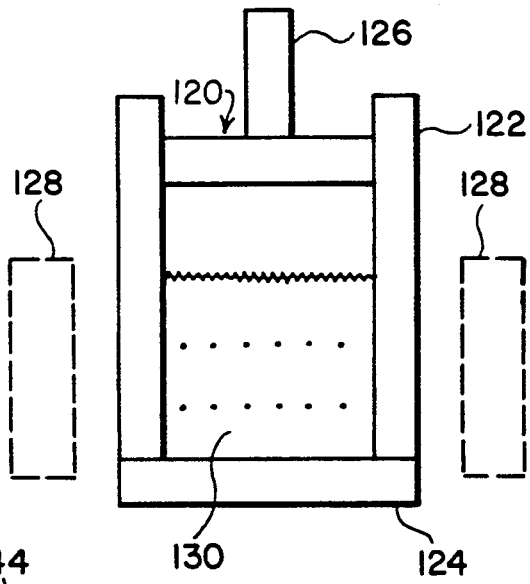
FIG. 3 illustrates a die press used in the invention.

Steps 27 and 29 are alternative cold pressing steps replacing steps 26 and 28. In step 27 alignment is in a die press as shown in FIG. 3. Thereafter, compaction in step 29 is by die pressing, typically in the press of FIG. 3. Referring to FIG. 3, die press 120 of steps 27 and 29 comprises a rigid wall 122, a base 124 and plunger 126. Magnet poles 128 create a magnetic field across die press 120 to align the powder 130 prior to pressing. It will be appreciated that either an axial or a radial magnetic field may be utilized to align powder 130. When alignment has been achieved, plunger 126 exerts a pressure of at least 100 tons/sq. in. on aligned powder 130 to compact the powder.

The dimension of the die press chamber may be adjusted to other shaped compacts such as radial magnets. For example, radial magnets may be made using a die press having a central mandrel as shown in U.S. Pat. No. 4,628,809 commonly assigned and incorporated herein by reference.

After step 28, or alternatively step 29, is completed, the compacted powder is placed in a vacuum in a hot isostatic pressing (HIP) can in step 30. The HIP can may be cylindrical or annular for radial magnet formation as noted above. The HIP can is placed in an argon containing sealed furnace and hot isostatically pressed at a pressure of 15–30 KPSI at a temperature of approximately 950°–1150° C. (typically 1100°–1150° C.) for 2–4 hours in step 32, shown in FIG. 1B.

Where initial homogenizing steps 12, 14 and 16 are followed, the HIP can is moved to a less than 50° C. zone of the furnace and quenched to a temperature of less than 50° C. in step 31. After quenching, the compact is removed from the HIP can in step 33.

Where the initial homogenizing steps 12, 14 and 16 are not followed, after step 32 the compact is removed from the HIP can in step 34. Thereafter, steps 12, 14 and 16 are performed as steps 50, 52 and 54 respectively.

After step 33, or alternatively step 54, is completed, the compacted powder is optimized by heat treating in an argon atmosphere furnace at atmospheric pressure at a temperature of 800°–850° C. for 4–6 hours in step 36. Upon completion of optimizing step 36, the powder is slow-cooled at the rate of 1°–2° C./minute to a temperature of approximately 400° C. in a step 38.

Steps 37 and 39 are alternatives to steps 36 and 38. In step 37, optimizing is effected by heating the densified body in an argon furnace at atmospheric pressure at a temperature of approximately 825° C. for approximately 40 hours. Thereafter, in step 39, the powder is cooled by 60° C. decrements to about 375°–425° C., typically 400° C. holding the temperature constant for 3–4 hours at each 60° C. step.

After step 38, or alternatively step 39, has been completed, the material is aged additionally at approximately 375°–425° C., typically 400° C. for 5–10 hours in a step 40. At the end of this aging period, the powder is cooled to room temperature and magnetized in a magnetic field of at least 50 KOe in a step 42 to produce the final magnet prior.

The above described embodiment of the present invention describes homogenizing (step 12) solution treating (step 14) and quenching (step 16) of the ingots of alloy prior to pulverization (step 18). This creates homogeneity prior to powder formation so that subsequent grain size growth in the hot isostatically pressed material can be limited to optimize magnetic properties. It has been observed that there is a greater degree of detrimental grain growth, resulting in lower magnet strength, when homogenization is achieved by steps 50, 52 and 54 rather than by steps 12, 14 and 16.

Figure 4:
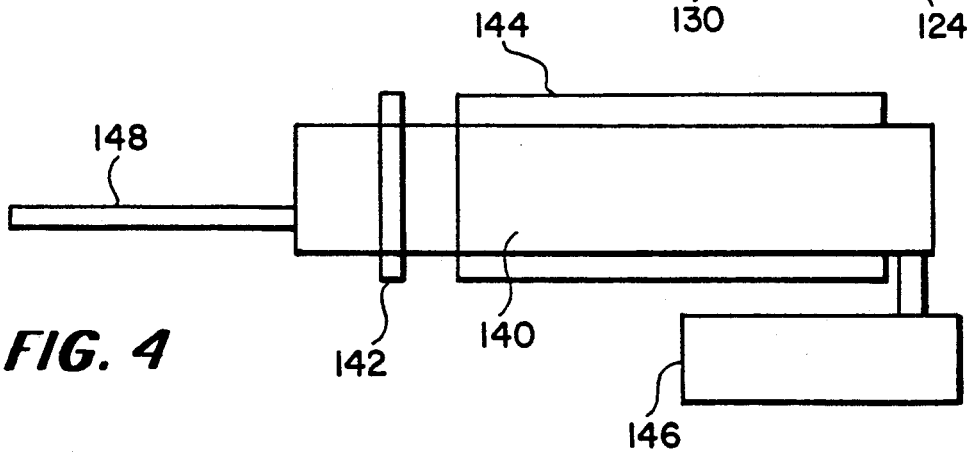
FIG. 4 illustrates an argon furnace having a push rod as used in the invention.

FIG. 4 illustrates a furnace 140 that may be used in homogenizing steps 12, 14 and 16 or, alternatively, steps 50, 52 and 54. The furnace interior is selectively heated by coils to produce zones of about 1180°–1200° C. and is cooled by coils 142 to produce zones of less than 50° C. An argon source 146 maintains a non-oxidizing atmosphere within furnace 140 and a pushrod 148 provides selective placement of the magnetic material at the desired temperatures. It will be appreciated that alternative furnaces, known to those skilled in the art, which are capable of producing the required elevated temperatures and cooling zones may be utilized.

The above described invention is illustrative of a novel process for fabricating high strength magnets which overcomes significant disadvantages of prior processes. For example, the process of the present invention permits production of high density magnets having fine grain size and high mechanical strength which facilitates machining of the magnets. In addition, magnets produced according to the present invention display improved and uniform magnetic properties. Other modifications, embodiments and departures from the present disclosure are possible without departing from the inventive concept herein. The invention is not be limited by what has been particularly shown and described except as indicated in the appended claims.

We claim:

1. A process for fabricating high strength magnets; the process comprising the following steps in the order recited:

heating a rare earth transition metal alloy comprising samarium, at a temperature of about 1180°–1200° C. for 2–24 hours;

solution treating said alloy at a temperature of about 1150° C. for 2–24 hours;

quenching said alloy to less than 50° C.;

reducing said alloy to a powder having a particle size in the range of approximately 5–10 microns;

exposing said powder to a magnetic field to magnetically align said powder;

substantially immobilizing said aligned powder by cold-pressing to produce a cold compact;

hot isostatically pressing said cold compact to a densified compact;

optimizing, said densified compact by heat treatment according to one of the following sets of treatment conditions (a) and (b):

(a) a temperature of about 800°–850° C. for 4–6 hours;

(b) a temperature of approximately 825° C. for approximately 40 hours;

slow cooling said optimized densified compact as a function of its optimization treatment, as follows:

when optimizing is carried out according to optimizing treatment conditions (a) above, cooling is carried out at 1°–2° C. per minute to a temperature of approximately 400° C.; and when optimizing is carried out according to optimizing treatment conditions (b) above, cooling is carried out in decrements of approximately 60° C. to approximately 375°–425° C., with the temperature being held for about 3–4 hours at each step;

aging said densified compact at a temperature of 375°–425° C. for approximately 5–10 hours;

cooling the aged densified compact; and thereafter magnetizing the aged densified compact.

2. The process of claim 1 wherein said heating step and said solution treating steps are performed in an argon furnace at atmospheric pressure.

3. The process of claim 1 wherein said exposing step includes placing said alloy powder in a magnetic field of a strength greater than 10KOe.

4. The process of claim 1 wherein said immobilizing step includes disposing said powder in a cold isostatic press and applying a force to said powder of about 50–60 KPSI.

5. The process of claim 4 wherein said immobilizing step further includes exposing said powder-containing cold isostatic press to a magnetic field of a strength greater than 10KOe.

6. The process of claim 1 wherein said immobilizing step includes disposing said powder in a die press and applying a force to said powder of about 120 tons/sq. in.

7. The process of claim 1 wherein said hot isostatic pressing step includes:

placing said cold compact in a vacuum in a hot isostatic press can;

placing said can in an argon containing furnace; and applying a force on said compact of 15–30 KPSI.

8. The process of claim 7 wherein the inside of said argon containing furnace is maintained at a temperature of about 950° C.–1150° C.

9. The process of claim 1 wherein said magnetizing step includes placing said compact in a magnetic field of a strength greater than 50KOe.

10. The process of claim 1 wherein said rare earth-transition metal alloy comprises the following constituents: Sm, Fe, Cu, Zr and Co.

* * * * *